US012693032B2

(12) United States Patent
Fong et al.

(10) Patent No.: US 12,693,032 B2
(45) Date of Patent: Jul. 28, 2026

(54) PORTABLE AND STACKABLE DEHUMIDIFIERS AND ASSOCIATED METHODS

(71) Applicant: Legend Brands, Inc., Burlington, WA (US)

(72) Inventors: Mark Fong, Bellingham, WA (US); Ryan Kulp, Bellingham, WA (US); Thomas Ryan Beaver, Richmond, VA (US); William M. Riley, Richmond, VA (US); Dillan Shaffer, Charlotte, NC (US); Matt Green, Charlotte, NC (US); Holly Coggins, Charlotte, NC (US); Guillermo Ramirez, Mount Vernon, WA (US)

(73) Assignee: Legend Brands, Inc., Burlington, WA (US)

( * ) Notice: Subject to any disclaimer, the term of this patent is extended or adjusted under 35 U.S.C. 154(b) by 53 days.

(21) Appl. No.: 18/435,811

(22) Filed: Feb. 7, 2024

(65) Prior Publication Data

US 2025/0251153 A1 Aug. 7, 2025

(51) Int. Cl.

| | |
|---|---|
| ***F24F 1/04*** | (2011.01) |
| ***F24F 1/0358*** | (2019.01) |
| ***F24F 13/20*** | (2006.01) |

(52) U.S. Cl.

CPC ..... *F24F 1/04* (2013.01); *F24F 13/20* (2013.01); *F24F 1/0358* (2019.02)

(58) Field of Classification Search

CPC ..... F24F 1/04; F24F 13/20; F24F 1/0358

See application file for complete search history.

(56) References Cited

U.S. PATENT DOCUMENTS

| | | | | |
|---|---|---|---|---|
| 8,616,597 | B2 * | 12/2013 | Guerra | B25G 1/00 294/58 |
| 2014/0150488 | A1 * | 6/2014 | Black | F24F 3/14 29/890.035 |
| 2018/0372371 | A1 * | 12/2018 | DeMonte | F24F 13/32 |

* cited by examiner

*Primary Examiner* — Lionel Nouketcha

(74) *Attorney, Agent, or Firm* — Perkins Coie LLP

(57) ABSTRACT

Handle assemblies for dehumidifiers and methods of operating dehumidifiers are provided. In some embodiments, the method includes (1) positioning a first dehumidifier on a top surface of a second dehumidifier; (2) aligning a wheel of the first dehumidifier to a recess on the top surface of the second dehumidifier; (3) positioning a first handle assembly of the first dehumidifier at a first location; and (4) positioning a second handle assembly of the second dehumidifier at a second location adjacent to the first location. The first handle assembly includes a first center portion and a first side portion coupled to the first center portion. The second handle assembly includes a second center portion and a second side portion coupled to the second center portion. The first center portion is configured to nest together with the second center portion.

16 Claims, 9 Drawing Sheets

PORTABLE AND STACKABLE DEHUMIDIFIERS AND ASSOCIATED METHODS

TECHNICAL FIELD

The present disclosure is directed generally to portable and stackable apparatus (e.g., dehumidifiers) and associated methods. More particularly, dehumidifier configurations that enable stacking and transporting operations for the portable and stackable dehumidifiers.

BACKGROUND

Dehumidifiers are used for removing moisture from air. A conventional dehumidifier typically directs air flow across several components of a refrigeration cycle. The components of the refrigeration cycle cool the air flow below the dew-point temperature so that water vapor in the air flow is condensed to liquid and removed from the air flow. Dehumidifiers are useful in many different applications. For example, dehumidifiers are frequently used in residential applications to reduce the level of humidity in the air for health reasons, as humid air can cause unwanted mold or mildew to grow inside homes. Dehumidifiers are also frequently used in commercial or industrial applications, for example to dry the air in water damage restoration projects. The drier air helps contractors restore buildings or other structures that have been flooded or suffered other types of water damage. Multiple dehumidifiers are often used in locations, such as building or other structures. Conventional dehumidifiers are not easily portable and stackable, and usually require professionals to transport, install, and operate on site. Therefore, it is advantageous to have an improved system to address the foregoing need.

DETAILED DESCRIPTION

Figure 1A:
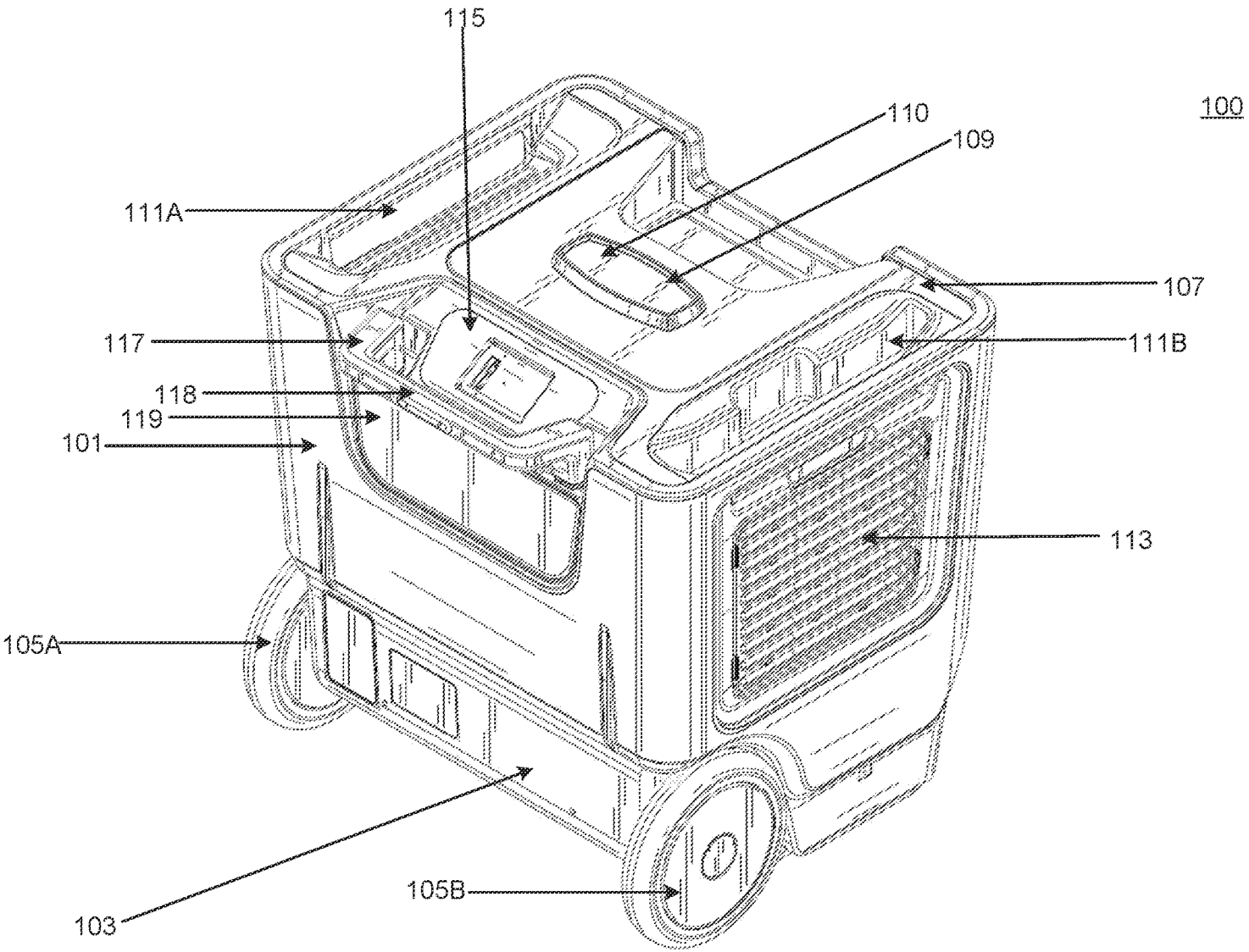
FIG. 1A is a perspective view of a dehumidifier configured in accordance with an embodiment of the present technology.

The present disclosure is directed generally to portable and stackable dehumidifiers with an improved handle assembly, and associated methods of manufacturing and operating the portable and stackable dehumidifiers. The present handle assembly enables an operator to conveniently stack two or more dehumidifiers and easily transport/move the stacked dehumidifiers.

One aspect of the present disclosure is a handle assembly for portable and stackable dehumidifiers. When two dehumidifiers are stacked, the handle assemblies of these two stacked dehumidifiers are closely fitted or connected with each other, such that portions of the handles nest together so an operator can grab or hold the two handle assemblies with a single hand so as to move or transport the two stacked dehumidifiers.

In some embodiments, the handle assembly includes a center portion (or a handle portion) and two side portions coupled to the center portion. Each of the side portions is coupled to a retractable component. The retractable component allows the handle assembly to be moved between a "stowed" position (see, e.g., FIGS. 1A-1C) and an "extended" position (see, e.g., FIGS. 2 and 3).

The center portion can be formed with a shape that can be fittingly nested or otherwise ergonomically connected with another handle assembly of another dehumidifier when in a stacked configuration. For example, the center portion can have an upper surface and a lower surface. The upper surface and the lower surface are formed with corresponding surface patterns (e.g., one having a protrusion, the other has a recess, see e.g., FIG. 6) such that the upper surface can be fittingly connected with the lower surface of anther center portion. In some embodiments, the handle assemblies can be connected by other mechanisms such as a latch, a hooking component, etc.

Another aspect of the present disclosure is methods for stacking and/or operating the stackable and portable dehumidifiers with the present handle assemblies. In some embodiments, the method can include, for example, (1) positioning a first dehumidifier on a top surface of a second dehumidifier; (2) aligning one or more wheels of the first dehumidifier in one or more mating recesses configured to receive and partially retain the wheels on the top surface of the second dehumidifier; (3) positioning a first handle assembly of the first dehumidifier at a first extended configuration; and (4) positioning a second handle assembly of the second dehumidifier at a second location adjacent to the first location so the handle portions of the first and second handle assemblies are nested together in an ergonomic configuration.

Yet another aspect of the present disclosure provides methods for a structure with two stacked dehumidifiers with the present handle assemblies. In some embodiments, the structure can include, for example, (1) a first dehumidifier having a first handle assembly; and (2) a second dehumidifier having a second handle assembly. The first handle assembly includes a first center portion and a first side portion coupled to the first center portion. The second handle assembly includes a second center portion and a second side portion coupled to the second center portion. The first dehumidifier is configured to be stacked on the second dehumidifier, and the first center portion is configured to nest together with the second center portion when the first dehumidifier and the second dehumidifier are stacked.

In some embodiments, the first handle assembly can further include a first retractable component coupled to the first side portion. The second handle assembly can further include a second retractable component coupled to the second side portion.

In some embodiments, the first dehumidifier can include a bottom surface and an alignment recess formed on the bottom surface. The second dehumidifier can include a top surface and an alignment projection formed on the top surface. The alignment projection is configured to be positioned in the alignment recess when the first dehumidifier is stacked on the second dehumidifier. Embodiments of the alignment recess and alignment projection are discussed in detail with reference to FIGS. 1B and 1C.

The following description identifies specific details with reference to FIGS. 1-7 to provide a thorough understanding of various embodiments of the disclosure. Other details describing well-known structures or processes often associated with dehumidifiers, however, are not described below to avoid unnecessarily obscuring the description of various embodiments of the disclosure. Moreover, although the following disclosure sets forth several embodiments of different aspects of the disclosure, other embodiments can have different configurations and/or different components than those described in this section. In addition, further embodiments of the disclosure may be practiced without several of the details described below, while still other embodiments of the disclosure may be practiced with additional details and/or features.

FIG. 1A is a perspective view of a dehumidifier 100 configured in accordance with an embodiment of the disclosure. The dehumidifier 100 is a compact, stackable, and portable dehumidifier. More particularly, the dehumidifier 100 can be a first dehumidifier that is securely and removably stackable atop on a second dehumidifier having the same or similar configuration as the first dehumidifier 100. Embodiments of stacked dehumidifiers are discussed in detail with reference to FIG. 2.

As shown in FIG. 1A, the dehumidifier 100 includes a mid-section portion 101, a tub 103, large, fitted wheels 105A, 105B, and a top section 107 with a cap 109 (or an alignment projection) positioned thereon. In some embodiments, the cap 109 can have a logo badge, product label, instruction information, brand information, advertisement, etc. thereon. In the illustrated embodiment, the dehumidifier 100 has at least two large, fitted wheels 105A, 105B attached to a front side of the tub 103. As shown, the top section 107 can be formed with two contoured wheel-recesses 111A, 111B on left and right sides of the top section generally above the wheels 105A and 105B. In some embodiments, the wheel recesses 111A, 111B are positioned and configured to accommodate and/or removably receive portions of the wheels from another dehumidifier (e.g., an upper dehumidifier with a similar configuration) when that upper dehumidifier is stacking on the dehumidifier 100 (e.g., a lower dehumidifier). In some embodiments, the top section 107 of the dehumidifier 100 can be contoured so as to receive and align another upper dehumidifier with a different or partially different configuration when stacked atop the lower dehumidifier 100.

As seen in FIG. 1A, the dehumidifier 100 of the illustrated embodiment can also include one or more vent grilles 113 for air passage (e.g., airflow in and/or out) through the mid-section portion 101 that contains dehumidifier components, such as an evaporator, a condenser, a compressor, a heat exchanger, a fan, a cooling coil, etc. These components are positioned inside the mid-section portion 101 and are arranged in a compact configuration, and the components can generate a significant amount of heat during operation. Airflow through the vent grilles 113 and through the mid-section portion 101 help with thermal management of the dehumidifier components during operation.

The dehumidifier 100 also includes a control panel 115 for an operator to control the dehumidifier 100 to perform a moisture removing process. In the illustrated embodiment, the control panel 115 is coupled to the front side of the mid-section portion 101 adjacent to the cap 109. The control panel 115 allows the user to control the dehumidifier's moisture removing process, which includes heating an incoming airflow of air via the evaporator, and cooling the heated incoming airflow by the condenser. The compressor is configured to management refrigerant flowing through the evaporator and/or the condenser during the moisture removing process. The heat exchanger is configured to balance and/or transfer heat energy during the moisture removing process.

As shown in FIG. 1A, the dehumidifier 100 includes a handle assembly 117. The handle assembly 117 of the illustrated embodiment is a telescoping, vertically extendible handle on the front side of the dehumidifier adjacent to a chest plate 119 coupled to the mid-section portion 101 below the cap 109. The handle assembly 117 is movable between a lowered, "stowed" position (FIG. 1A) and a raised, "extended" position. When the handle assembly 117 is in the lowered, stowed position, at least a portion of the handle assembly 117 is positioned outwardly adjacent to the control panel 115 so as to provide structural protection for the control panel 115 during use of the dehumidifier 100. In the illustrated embodiment, the handle assembly 117 has an ergonomically contoured handle portion 118 shaped and sized to be grasped by a user. For example, when the handle assembly 117 is in the raised, extended position, a user can grasp the contoured handle portion 118, tip the dehumidifier onto the wheels 105A, 105B, and easily push or pull the dehumidifier to transport it to a desired location. The handle assembly 117 is also configured, so that when two dehumidifiers are stacked together, with the handle assembly in the lower unit in the raised, extended position and the handle assembly of the upper unit in the lowered, stowed position, the ergonomic handle portions 118 of the two handle assemblies fittingly interconnect or nest with each other. This enables an operator or a user to conveniently grab, grasp and hold both handle assemblies at the same time while rolling or otherwise moving the stacked dehumidifiers.

Figure 1B:
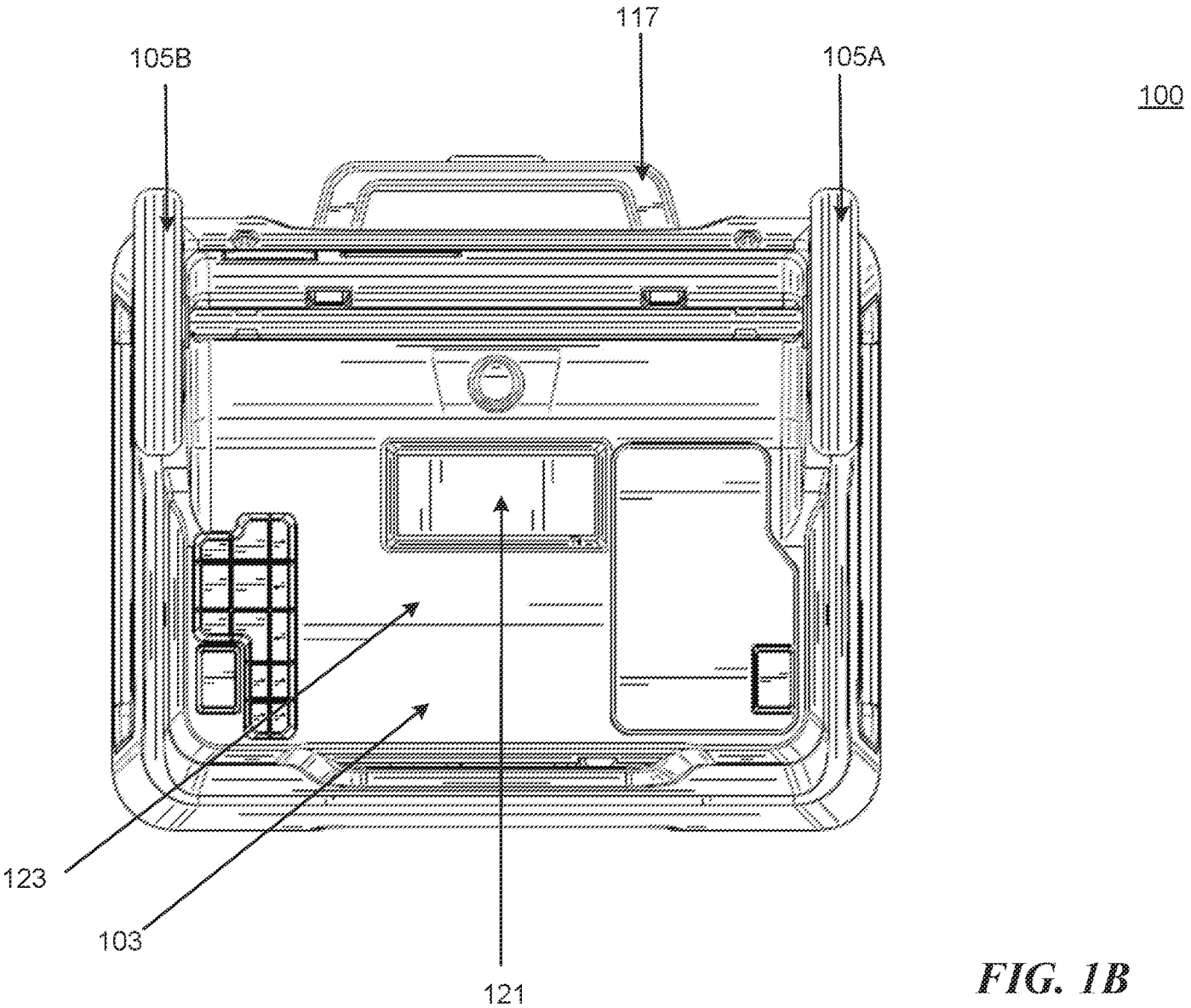
FIG. 1B is a bottom plan view of the dehumidifier of FIG. 1 configured in accordance with an embodiment of the present technology.

In some embodiments, the dehumidifier 100 can also include an alignment projection 110 configured to help establish and maintain proper alignment of two dehumidifiers when stacked together. In the illustrated embodiments of FIG. 1A, the cap 109 is one implementation with an integral alignment projection 110 extending upwardly. As seen in FIG. 1B, the bottom 123 of the dehumidifier 100 includes an alignment recess 121 with a shape inversely similar to the alignment projection 110 (FIG. 1A). When two of the dehumidifiers 100 are stacked together, the alignment projection 110 of the lower dehumidifier closely fits into the alignment recess 123 of the upper dehumidifier to help align and hold the dehumidifiers together and to block the upper dehumidifier 100 from sliding laterally on the lower dehumidifier.

Figure 1C:
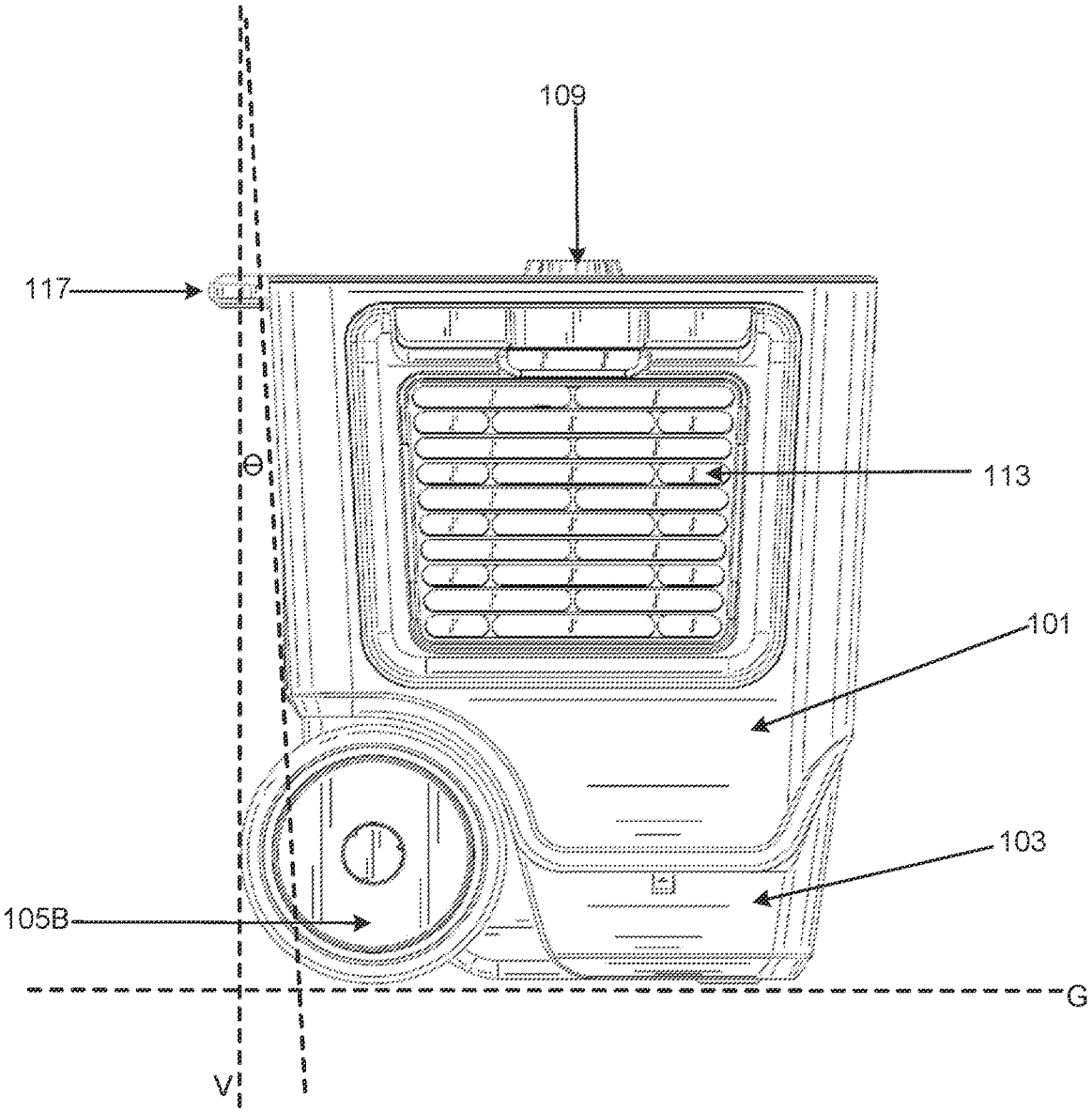
FIG. 1C is a side elevation view of the dehumidifier of FIG. 1.

FIG. 1C is a side view of the dehumidifier 100 configured in accordance with an embodiment of the disclosure. As shown in FIG. 1C, the mid-section component 101 is shaped to form an angle "Θ" relative to a vertical axis V (e.g., vertical to ground surface G). The handle assembly 117 is positioned inside and in align with the mid-section component 101. By this arrangement, the handle assembling 117 can fittingly connect or nest with a handle assembly of another dehumidifier when in a stacked arrangement. In some embodiments, the angle "Θ" can have a range of 5 to 30 degrees, depending on various design needs.

Figure 2:
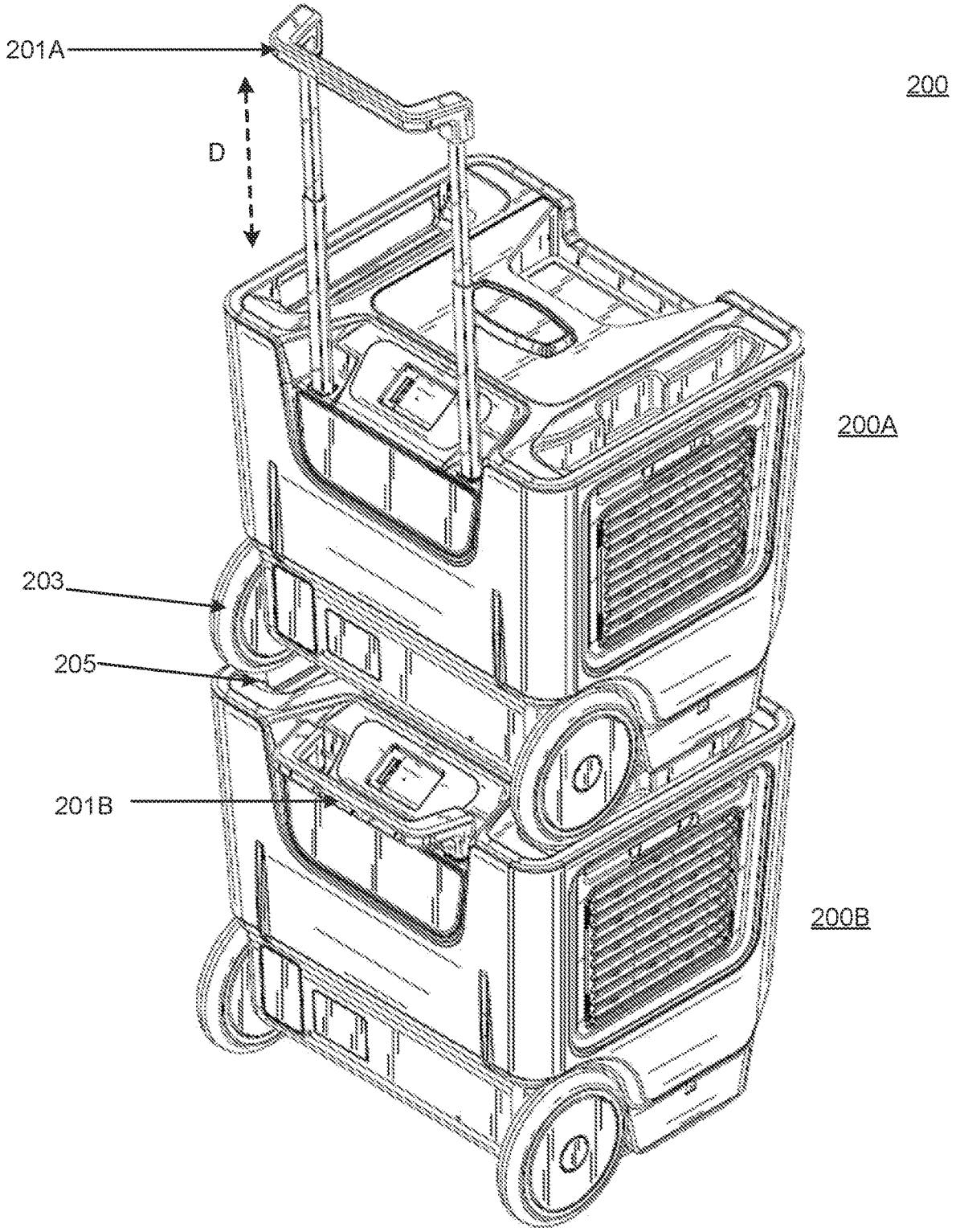
FIG. 2 is a perspective view of two portable dehumidifiers of the present technology in a stacked configuration in accordance with an embodiment of the present technology.

FIG. 2 is a perspective view of an arrangement 200 two stacked dehumidifiers in a stacked configuration in accordance with an embodiment of the disclosure. The arrangement 200 includes a first dehumidifier 200A (top) and a second dehumidifier 200B (bottom). The first and second dehumidifiers 200A and 200B each have a construction similar to the dehumidifier 100 discussed above. In the illustrated embodiment, the first dehumidifier 200A (top) includes a first handle assembly 201A. The second dehumidifier 200B (bottom) includes a second handle assembly 201B. The wheels 203 of the first dehumidifier 200A (top) are aligned with and positioned partially in recesses 205 formed on a top surface of the second dehumidifier 200B (bottom). The alignment projection 110 (FIG. 1A) of the second dehumidifier 200B closely fits into the alignment recess 123 of the upper dehumidifier. When the first dehumidifier 200A is stacked on the second dehumidifier 200B, an operator can adjust the positions of the first handle assembly 201A and the second handle assembly 201B, such that these two handle assemblies can be nested with each other for the operator to grasp and hold with a single hand.

For example, in the illustrated embodiments, the first handle assembly 201A is in an extended position, whereas the second handle assembly 201B is in a stowed position. An operator can first adjust the position of the first handle assembly 201A in direction D to a desirable position (e.g., depending on operator's preference, operation needs, and/or his/her height). Then the operator can adjust the position of the second handle assembly 201B "upwardly" (in a direction generally parallel to direction D) until the handle portions 118 of the two handle assemblies 201A and 201B are connected or other immediately next to each other and nested together, so a user can easily and comfortably grasp both handle portions 118 simultaneously.

In some embodiments, the handle portion 118 of each handle assembly 201A/201B can have a lower surface with a contour or pattern (curved, protruded, recessed, notched, zigzagged, etc.), and an upper surface with a mating contour or pattern, so that the upper surface of one handle portion 118 will mateably fit with the lower surface of another handle portion 118 when the two handle portions 118 are positioned together as discussed above. Accordingly, the first handle assembly 201A and the second handle assembly 201B can be fittingly connected and nested with each other when two dehumidifiers are stacked together. In the illustrated embodiment, the first handle assembly 201A and the second handle assembly 201B both have a handle portion 118 with a narrow center design so as to enable the operator to grasp and hold both handle portions 118 of the first and second handle assemblies 201A/201B a single hand when the two handle portions 118 are nested together.

Figure 3:
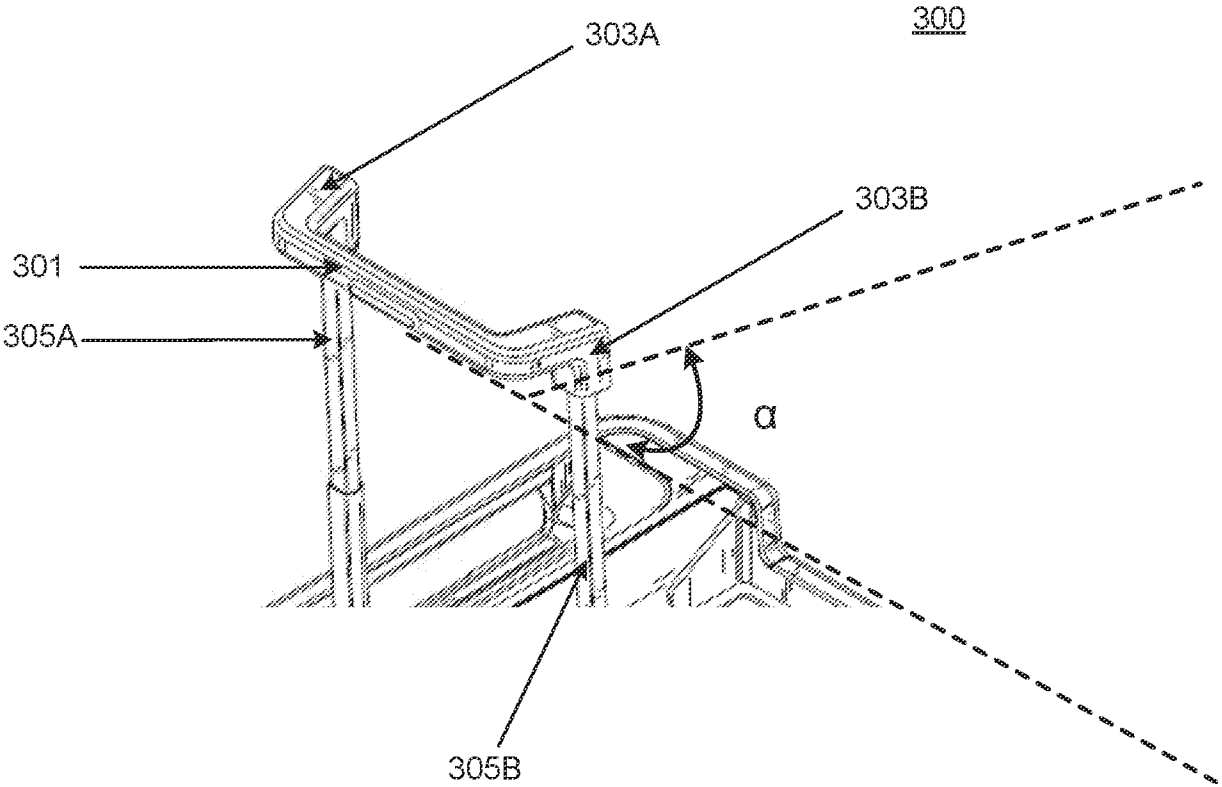
FIG. 3 is an enlarged, perspective view of a handle assembly of a dehumidifier in accordance with an embodiment of the present technology.

FIG. 3 is an enlarged, perspective view of a handle assembly 300 in accordance with an embodiment of the disclosure. The handle assembly 300 is a telescoping assembly that includes the center handle portion 301 (or a narrow portion) and two side portions 303A, 303B (or wide portions) coupled to the center portion 301. The side portions 303A, 303B are coupled to telescoping or otherwise retractable components, 305A, 305B, respectively, configured to allow the extendible handle to move between the extended and retracted positions relative to the front side of the dehumidifier. The retractable component 305A is configured to be operably positioned inside the retractable component 305B such that the total length of the retractable handle can vary. The center portion 301 is formed in a shape that can be fittingly connected with another handle assembly of another dehumidifier as discussed above. In the illustrated embodiments, the center portion 301 is "narrower" or smaller in size than the side portions 303A, 303B. in some embodiments, the center portion 301 and the side portions 303A, 303B can be integrally connected. In some embodiments, the center portion 301 and the side portions 303A, 303B can be separate, modularized components such that a manufacturer or an operator can select a suitable center portion for a handle assembly.

In the illustrated embodiment, the side portions 303A, 303B are positioned to form an angle "α" relative to the center portion 301. In some embodiments, the angle "α" can have a range of 25 to 90 degrees, depending on various design needs. In some embodiments, the angle "α" can be a factor to consider when designing the shape of the handle assembly 300. For example, a larger angle "α" corresponds to a longer center portion 301. In some embodiments, the center portion 301 and the side portions 303A, 303B can be modularized components, which enables a user to swap suitable center/side portions based on his/her hand size and/or preference.

Figure 4:
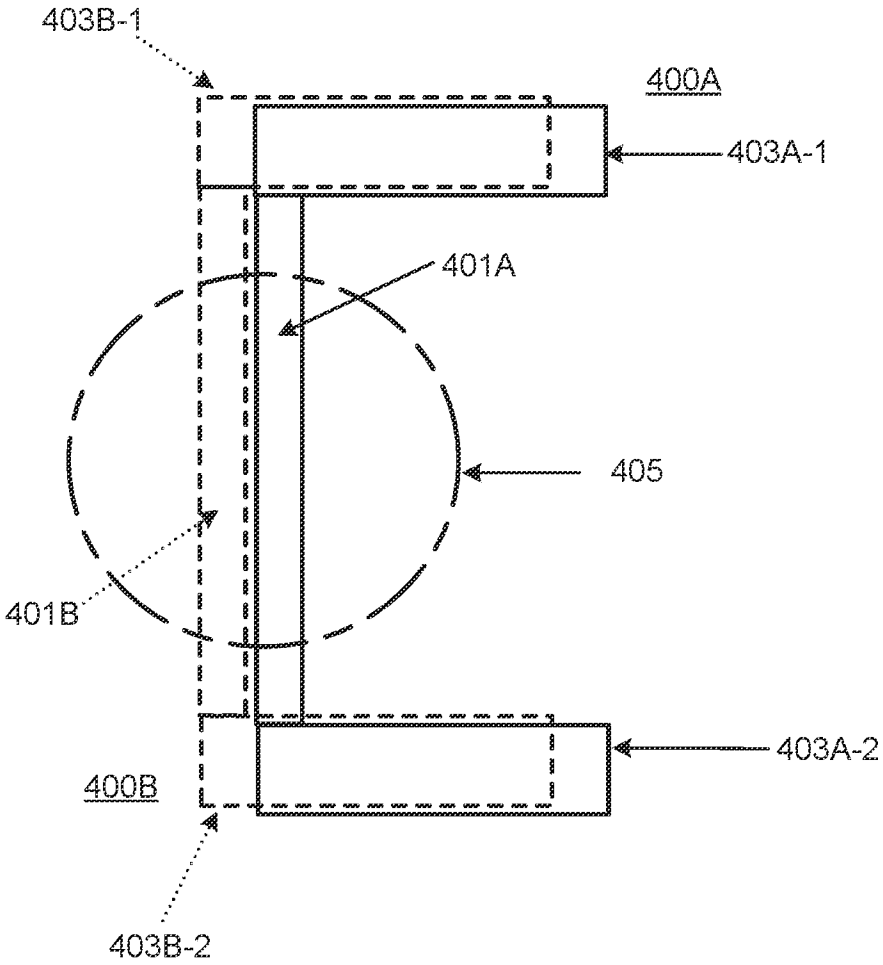
FIG. 4 is a top, schematic view of handle assemblies of dehumidifiers in a nested configuration in accordance with an embodiment of the present technology.
Figure 5:
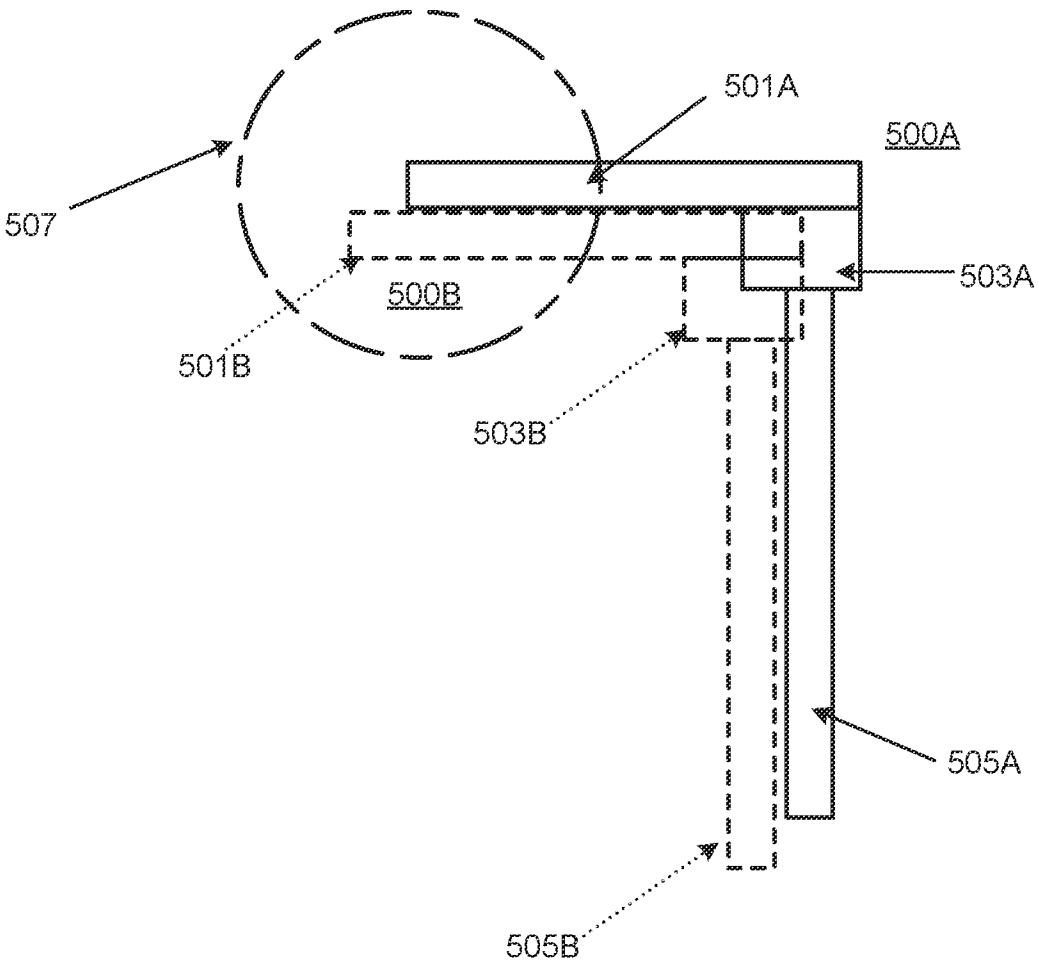
FIG. 5 is a side, schematic view of a nested handle assemblies in accordance with an embodiment of the present technology.

FIGS. 4 and 5 illustrate embodiments showing two handle assemblies are nested together and accordingly a grasping area is formed. FIG. 4 is a top, schematic view of a first handle assembly 400A nested with a second handle assembly 400B in accordance with an embodiment of the disclosure. The first handle assembly 400A belongs to a top first dehumidifier. The second handle assembly 400B belongs to a bottom second dehumidifier stacked with the top first dehumidifier. The first handle assembly 400A includes a first center portion 401A and two side portions 403A-1, 403A-2. The second handle assembly 400B includes a second center portion 401B and two side portions 403B-1, 403B-2. As shown in FIG. 4, the first center portion 401A and the second center portion 401B are nested together and form an integrated component 405 for an operator or a user to grasp and hold when the first dehumidifier and the second dehumidifier are stacked.

FIG. 5 is a side, schematic view of a nested handle assemblies in accordance with an embodiment of the present technology. FIG. 5 shows a first handle assembly 500A and a second handle assembly 500B. The shapes and sizes of the assembly 500A and a second handle assembly 500B are different from those of the first handle assembly 400A and second handle assembly 400B discussed in FIG. 4. The first handle assembly 500A belongs to a top first dehumidifier. The second handle assembly 500B belongs to a bottom second dehumidifier stacked with the top first dehumidifier. The first handle assembly 500A includes a first center portion 501A, a side portion 503A (positioned below the first center portion 501A), and a retractable component 505A. The second handle assembly 500B includes a second center portion 501B, a side portion 503B (positioned below the second center portion 501B), and a retractable component 505B. As shown in FIG. 5, the first center portion 501A and the second center portion 501B are nested together and form an integrated component 507 for an operator or a user to grasp and hold when the first dehumidifier and the second dehumidifier are stacked.

Figure 6:
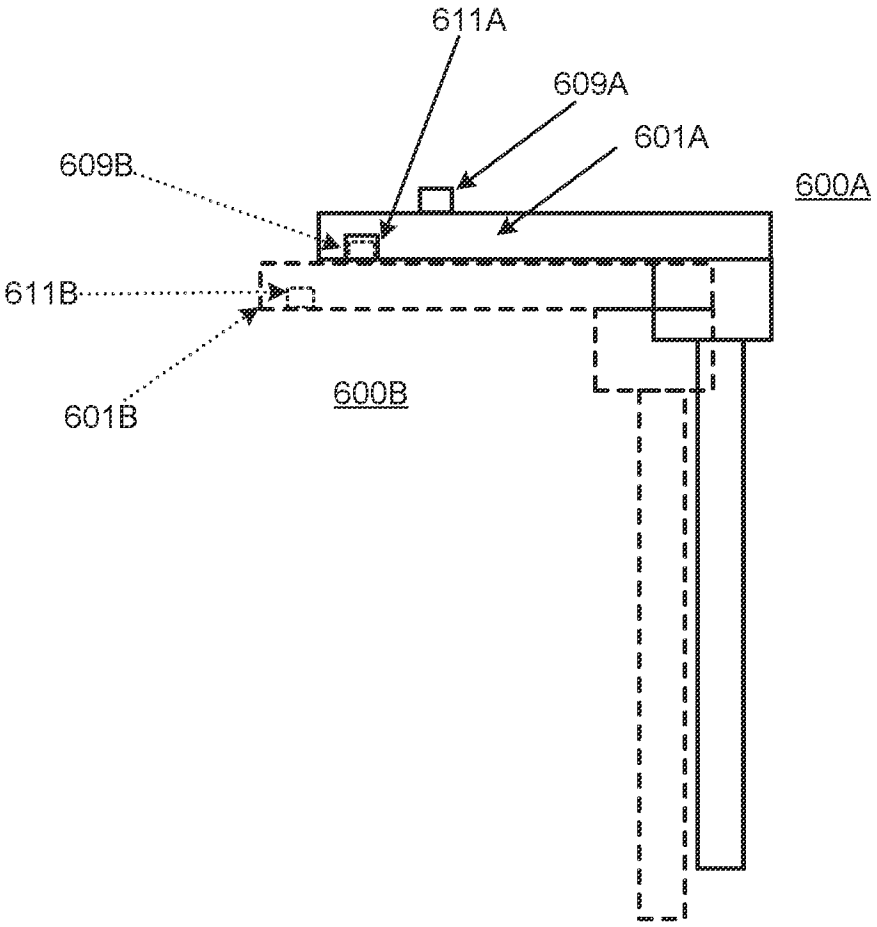
FIG. 6 is a side, schematic view of handle assemblies of dehumidifiers in a nested configuration in accordance with an embodiment of the present technology.

In some embodiments, the handle assemblies discussed herein can be connected together via mechanisms such as latches, clips, matching curved/notched structures, etc. For example, FIG. 6 is a side, schematic view of a first and second handle assemblies 600A and 600B of two humidifiers, respectively, stacked together as discussed above. The first handle assembly 600A includes a first center portion 601A. The first center portion 601A can be formed with a protrusion 609A on its top surface and a recess 611A on its bottom surface. The second handle assembly 600B includes a second center portion 601B. Similarly, the second center portion 601B can be formed with a protrusion 609B on its top surface and a recess 611B on its bottom surface. As shown in FIG. 6, the first center portion 601A and the second center portion 601B are nested together and the protrusion 609B is positioned inside the recess 611A. By this arrangement, the first center portion 601A and the second center portion 601B are fitting connected and secured together, which enables an operator or a user to grasp and hold both the first handle assembly 600A and the second handle assembly when transporting or moving the stacked first and second dehumidifiers.

Figure 7:
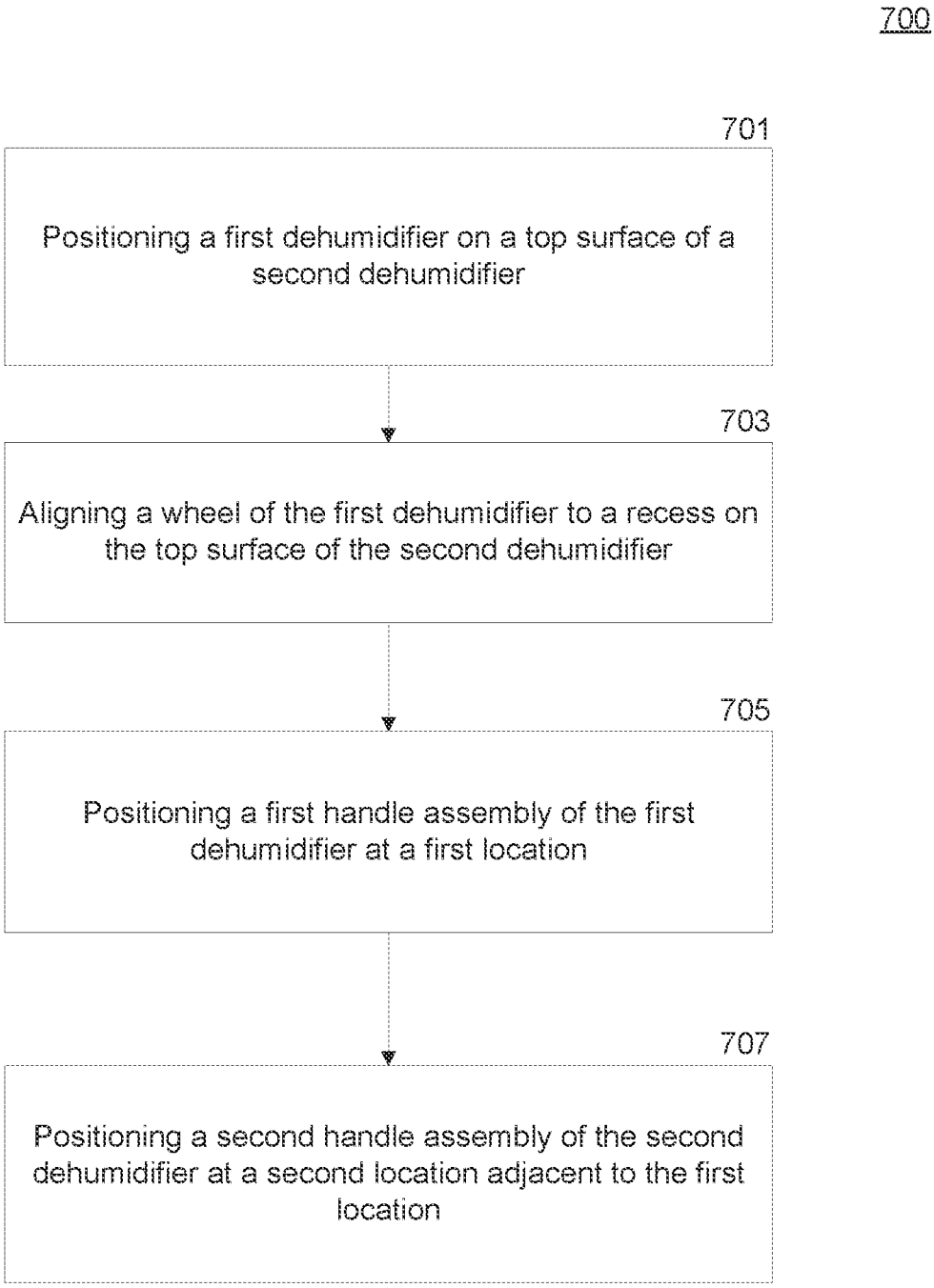
FIG. 7 is a flow diagram showing a method in accordance with embodiments of the present technology.

FIG. 7 is a flow diagram showing a method 700 in accordance with one or more embodiments of the present technology. The method 700 can be implemented to stack, transport, and operate two dehumidifiers. The method 700 starts at block 701 by positioning a first dehumidifier on a top surface of a second dehumidifier. Embodiments of stacking or positioning dehumidifiers are discussed herein with reference to the dehumidifiers discussed above and as shown in FIG. 2.

At block 703, the method 700 continues by aligning a wheel of the first dehumidifier to a recess on the top surface of the second dehumidifier. At block 705, the method 700 continues by positioning a first handle assembly of the first dehumidifier at a first location. At block 707, the method 700 continues by positioning a second handle assembly of the second dehumidifier at a second location adjacent to the first location. The first handle assembly can include a first center portion and a first side portion coupled to the first center portion. The second handle assembly can include a second center portion and a second side portion coupled to the second center portion. The first center portion is configured to nest together with the second center portion.

In some embodiments, the first location and the second location can be determined based on a user preference. For example, the first handle assembly can be in the fully raised, extended position, and the second handle assembly can be in the fully lowered, stowed position. Embodiments of positioning the handle assemblies are discussed herein with reference to FIG. 2.

In some embodiments, the method 700 further comprises positioning an alignment projection formed on the top surface the second dehumidifier to an alignment recess formed on a bottom surface of the first dehumidifier. Embodiments of the alignment projection and alignment recess are discussed herein with reference to FIGS. 1A-1C.

In some embodiments, the method 700 further comprises forming an integrated component by positioning the first handle assembly and the second handle assembly. In some embodiments, the method 700 further comprises enabling an operator to operate the first dehumidifier and the second dehumidifier via the integrated component via a single hand of the operator. Embodiments of the integrated component are discussed herein with reference to FIGS. 4-5.

From the foregoing, it will be appreciated that specific embodiments of the disclosure have been described herein for purposes of illustration, but that various modifications may be made without deviating from the scope of the disclosure. In addition, aspects described in the context of particular embodiments may be combined or eliminated in other embodiments. Further, although advantages associated with certain embodiments have been described in the context of those embodiments, other embodiments may also exhibit such advantages, and not all embodiments need necessarily exhibit such advantages to fall within the scope of the disclosure.

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" (or the like) in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the claims are not to be limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

The above detailed description of embodiments of the technology are not intended to be exhaustive or to limit the technology to the precise forms disclosed above. Although specific embodiments of, and examples for, the technology are described above for illustrative purposes, various equivalent modifications are possible within the scope of the technology as those skilled in the relevant art will recognize. For example, although steps are presented in a given order, alternative embodiments may perform steps in a different order. The various embodiments described herein may also be combined to provide further embodiments.

From the foregoing, it will be appreciated that specific embodiments of the technology have been described herein for purposes of illustration, but well-known structures and functions have not been shown or described in detail to avoid unnecessarily obscuring the description of the embodiments of the technology. Where the context permits, singular or plural terms may also include the plural or singular term, respectively.

As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number, respectively. Additionally, the term "comprising" is used throughout to mean including at least the recited feature(s) such that any greater number of the same feature and/or additional types of other features are not precluded, unless context suggests otherwise. It will also be appreciated that specific embodiments have been described herein for purposes of illustration, but that various modifications may be made without deviating from the technology. Further, while advantages associated with some embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Any listing of features in the claims should not be construed as a Markush grouping.

We claim:

1. A structure, comprising:

a first dehumidifier having a first handle assembly, the first handle assembly including a first center portion and a first side portion coupled to the first center portion; and a second dehumidifier having a second handle assembly, the second handle assembly including a second center portion and a second side portion coupled to the second center portion, wherein the first and second dehumidifiers are movable between a stacked position with the first dehumidifier stacked atop the second dehumidifier, and an unstacked position with the first dehumidifier spaced apart from the second dehumidifier;

wherein at least the second handle assembly is movable relative to the first dehumidifier to an extended position; and wherein the second center portion of the second handle assembly is configured to be adjected to and nest together with the first center portion when the first and second dehumidifiers are in the stacked position and the second handle assembly is in the extended position.

2. The structure of claim 1, wherein:

the first handle assembly further includes a first retractable component coupled to the first side portion.

3. The structure of claim 2, wherein:

the second handle assembly further includes a second retractable component coupled to the second side portion.

4. The structure of claim 1, wherein the first center portion is configured to fittingly connected with the second center portion.

5. The structure of claim 1, wherein the first center portion includes a lower surface, and wherein the second center portion includes an upper surface, and wherein the lower surface has a shape corresponding to the upper surface.

6. The structure of claim 1, wherein the first center portion includes a lower surface, and wherein the second center portion includes an upper surface, and wherein the lower surface is curved corresponding to the upper surface.

7. The structure of claim 1, wherein the first center portion includes a lower surface, and wherein the second center portion includes an upper surface, and wherein the lower surface is contoured corresponding to the upper surface.

8. The structure of claim 1, wherein the first dehumidifier includes a first wheel configured to be partially positioned in a recess formed on a top surface of the second dehumidifier.

9. The structure of claim 1, wherein:

the first handle assembly is operably positioned in a mid-section component of the first dehumidifier.

10. The structure of claim 1, wherein the first dehumidifier includes a bottom surface and an alignment recess formed on the bottom surface.

11. The structure of claim 10, wherein the second dehumidifier includes a top surface and an alignment projection formed on the top surface.

12. The structure of claim 11, wherein the alignment projection is configured to be positioned in the alignment recess when the first dehumidifier is stacked on the second dehumidifier.

13. A method for operating dehumidifiers, comprising:

positioning a first dehumidifier on a top surface of a second dehumidifier;

aligning a wheel of the first dehumidifier to a recess on the top surface of the second dehumidifier;

positioning a first handle assembly of the first dehumidifier at a first location; and positioning a second handle assembly of the second dehumidifier at a second location adjacent to the first location, wherein the first handle assembly includes a first center portion and a first side portion coupled to the first center portion;

wherein the second handle assembly includes a second center portion and a second side portion coupled to the second center portion;

wherein the first center portion is configured to nest together with the second center portion.

14. The method of claim 13, further comprising:

positioning an alignment projection formed on the top surface the second dehumidifier to an alignment recess formed on a bottom surface of the first dehumidifier.

15. The method of claim 13, further comprising:

forming an integrated component by positioning the first handle assembly and the second handle assembly.

16. The method of claim 15, further comprising:

enabling an operator to operate the first dehumidifier and the second dehumidifier via the integrated component via a single hand of the operator.

* * * * *